US006349981B1

(12) United States Patent
King

(10) Patent No.: US 6,349,981 B1
(45) **Date of Patent: *Feb. 26, 2002**

(54) LATCHING DEVICE

(76) Inventor: Richard King, 105 West La., Sayville, NY (US) 11782

( * ) Notice: Subject to any disclaimer, the term of this patent is extended or adjusted under 35 U.S.C. 154(b) by 0 days.

This patent is subject to a terminal disclaimer.

(21) Appl. No.: 09/465,149

(22) Filed: Dec. 16, 1999

Related U.S. Application Data

(63) Continuation of application No. 08/877,063, filed on Jun. 17, 1997, now Pat. No. 6,003,908.

(51) Int. Cl.[7] ..... E05C 5/02
(52) U.S. Cl. ..... 292/61; 292/DIG. 13
(58) Field of Search ..... 292/57, 58, 60–62, 292/67, 69, 71

(56) References Cited

U.S. PATENT DOCUMENTS

| | | | | | |
|---|---|---|---|---|---|
| 266,601 | A | * | 10/1882 | Blayney | 295/22 |
| 301,005 | A | | 6/1884 | Reiff | |
| RE10,887 | E | * | 12/1887 | Reinsch | 292/4 |
| 504,262 | A | * | 8/1893 | Adams | 14/62 |
| 706,595 | A | | 8/1902 | Potter | |
| 810,045 | A | | 1/1906 | Etzenhouser | |
| 1,064,313 | A | * | 6/1913 | Garlock | 292/60 |
| 1,262,809 | A | * | 4/1918 | Kolody | 292/57 |
| 1,675,033 | A | | 6/1928 | Lefkovitz | |
| 1,696,045 | A | | 12/1928 | Lach | |
| 1,770,751 | A | * | 7/1930 | Hall | 292/57 |
| 2,146,142 | A | | 2/1939 | Heasley | |
| 4,744,392 | A | * | 5/1988 | Tade | 292/59 |
| 5,125,695 | A | * | 6/1992 | Hartwell | 292/62 |
| 6,003,908 | A | * | 12/1999 | King | 292/61 |

* cited by examiner

*Primary Examiner*—Gary Estremsky
(74) *Attorney, Agent, or Firm*—Galgano & Burke

(57) ABSTRACT

A latch includes an angled bracket having a front flange and a rear flange, each flange defining a hole, a cylindrical bolt having a front end and a rear end with an orthogonal bolt handle located intermediate of the front and rear ends, and a coil spring. The angled bracket includes at least two substantially orthogonal contiguous sides which extend from the front flange to the rear flange where these sides contain a substantially U-shaped slot, a portion of which lies on one of the sides and a portion of which lies on the other side. The bolt is arranged relative to the angled bracket such that the bolt handle extends through the slot and the ends of the bolt extend through the respective holes in the flanges. The spring is arranged coaxial to the bolt and biases the bolt forward to a latched position. In order to move the bolt to the unlatched position, the bolt must be both rotated and translated for the bolt handle to move through the U-shaped slot. The substantially U-shaped slot is preferably formed with an additional forward bend so that the bolt must be translated, rotated, and translated again to be moved from the latched position to an unlatched position. The angled bracket is preferably formed with five sides and is provided with mounting holes for attaching it to a cage. The disclosed bolt is formed as a stepped cylinder to provide a point of annular engagement with the spring.

5 Claims, 5 Drawing Sheets

LATCHING DEVICE

This application is a continuation application of U.S. application Ser. No. 08/877,063 filed Jun. 17, 1997 now U.S. Pat. No. 6,003,908.

BACKGROUND OF THE INVENTION

1. Field of the Invention

The invention relates to latching devices. More particularly, the invention relates to latching devices which are particularly useful for animal cages.

2. State of the Art

A portion of a state of the art animal cage is shown in prior art FIG. 1. The cage 10 is provided with a hinged door 12 and a spring biased latch 14 which is located to engage or abut a tab 16 on the door 12 when the door is closed. Details of the latch 14 are shown in prior art FIGS. 2–5.

As seen best in prior art FIGS. 2 and 3, the latch 14 generally includes a U-shaped bracket 18 having a front flange 20 and a rear flange 22, each of which defines a keyed hole 24, 26, an L-shaped bolt 28 having two spaced apart flanges 30, 32 (typically formed by crimping), and a coil spring 34. The bolt 28 is placed so that it extends through the holes 24, 26 as shown in FIGS. 2, 4, and 5. The spring 34 is arranged coaxially with the bolt 28 and is located between the rear flange 22 of the bracket 18 and the first flange 30 on the bolt 28 thereby biasing the bolt 28 forward into the hole 24. As seen best in FIGS. 2 and 3, when the flange 32 on the bolt 28 is aligned with the keyed hole 24 in the front flange 20 of the bracket 18, the biasing action of the spring 34 moves the bolt 28 forward through the hole 24 into a "latched" position. In the position shown in FIG. 2, the end of the bolt 28 can engage of abut the tab 16 (FIG. 1) on the door to latch the door shut. From the foregoing it will be appreciated that the latch 14 can be moved to an "unlatched" position by pulling the bolt 28 back against the spring 34 as shown in FIG. 4. The bolt can be held in the "unlatched" position by rotating it so that the flange 32 is no longer in alignment with the keyed hole 24 as shown in FIG. 5.

The prior art latch 14 provides a simple and inexpensive means for locking the door of an animal cage so that the animal cannot escape. However, as shown in FIGS. 6–8, the latch 14 is so simple in its design that it is possible to disable the latch by pulling the bolt 28 back far enough so that the end of the bolt is pulled out of the hole 24 as shown in FIG. 7. When released from the position shown in FIG. 7, the bolt 28 is likely to fall away from the bracket 18 as shown in FIG. 8, at which time the latch is no longer effective. Those skilled in the art of animal care will appreciate that some animals possess the physiological ability as well as the intelligence to disable the latch in this manner. In particular, some large birds have demonstrated the ability to learn how to disable the state of the art latch and thereby release themselves from the cage.

SUMMARY OF THE INVENTION

It is therefore an object of the invention to provide a latch for an animal cage which cannot easily be disabled.

It is also an object of the invention to provide a latch for an animal cage which is resistant to operation by an animal.

It is another object of the invention to provide a latch for an animal cage which is relatively simple to operate.

It is still another object of the invention to provide a latch for an animal cage which is relatively inexpensive to manufacture.

In accord with these objects which will be discussed in detail below, the latch of the present invention includes an angled bracket having a front flange and a rear flange, each flange defining a hole, a cylindrical bolt having a front end and a rear end with an orthogonal bolt handle located intermediate of the front and rear ends, and a coil spring. According to the invention, the angled bracket includes at least two substantially orthogonal contiguous sides which extend from the front flange to the rear flange where these sides contain a substantially U-shaped slot, a portion of which lies on one of the sides and a portion of which lies on the other side. The bolt is arranged relative to the angled bracket such that the bolt handle extends through the slot and the ends of the bolt extend through the respective holes in the flanges. The spring is arranged coaxial to the bolt and biases the bolt forward to a latched position. In order to move the bolt to the unlatched position, the bolt must be both rotated and translated for the bolt handle to move through the U-shaped slot.

According to a presently preferred embodiment, the substantially U-shaped slot is formed with an additional forward bend so that the bolt must be translated, rotated, and translated again to be moved from the latched position to an unlatched position. According to the disclosed exemplary embodiment, the angled bracket is formed with five sides and is provided with mounting holes for attaching it to a cage. The disclosed bolt is formed as a stepped cylinder to provide a point of annular engagement with the spring.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
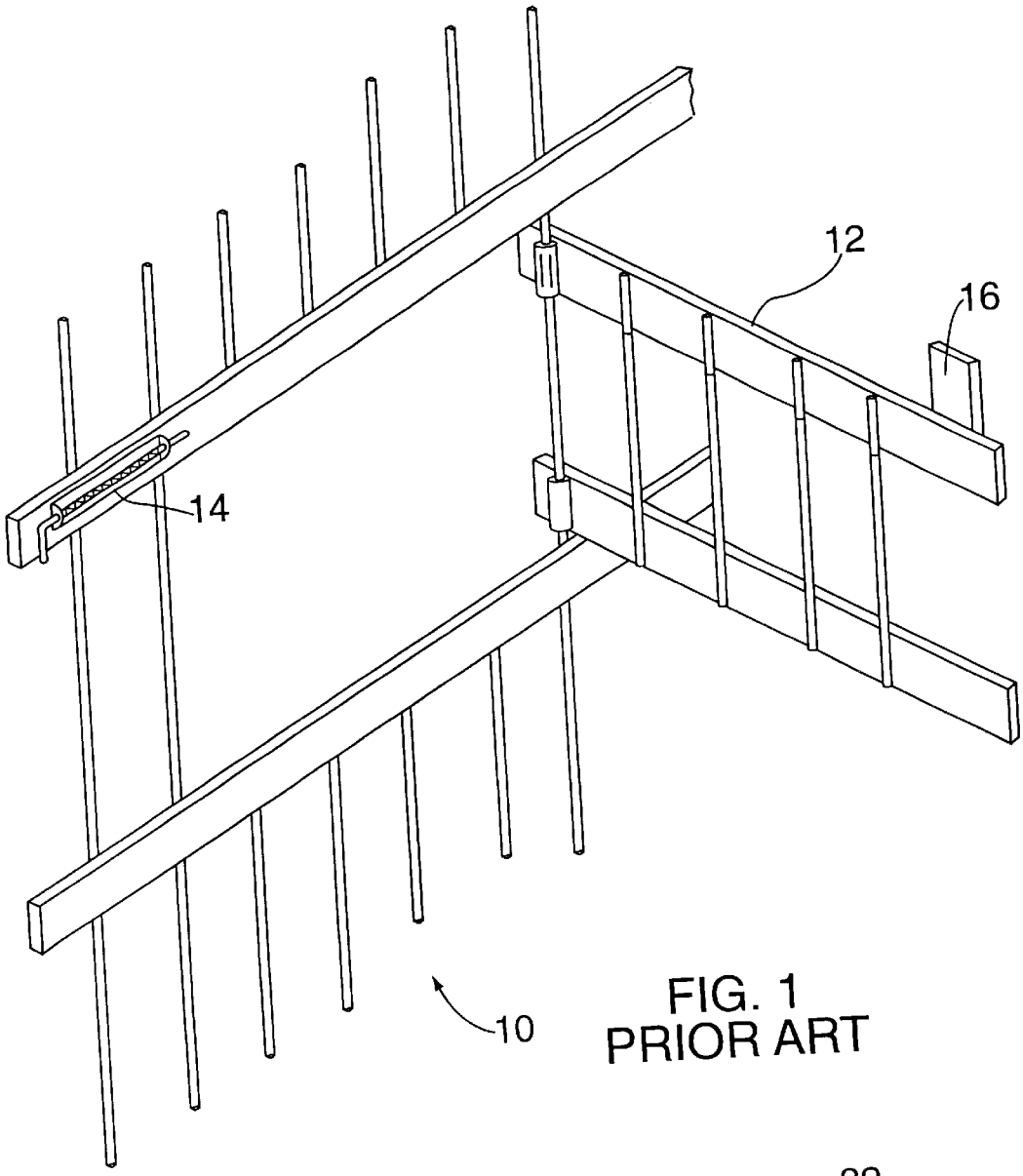
FIG. 1 PRIOR ART
FIG. 1 is a broken perspective view of a prior art cage with a prior art door latch.
Figure 2:
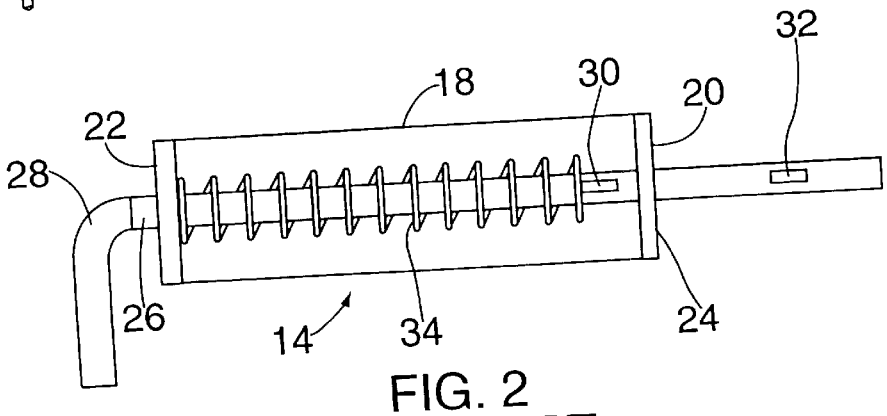
FIG. 2 PRIOR ART
FIG. 2 is an enlarged side elevation view of the prior art latch of FIG. 1 in a "latched" position.
Figure 4:
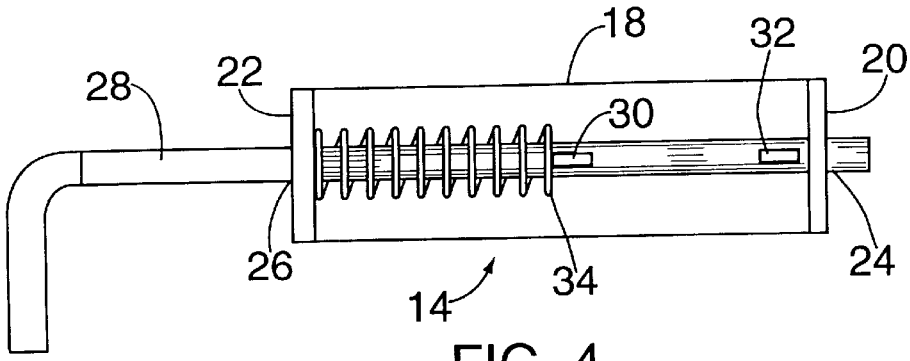
FIG. 4 PRIOR ART
FIG. 4 is a view similar to FIG. 2 of the prior art latch in a position intermediate of latched and unlatched.
Figure 3:
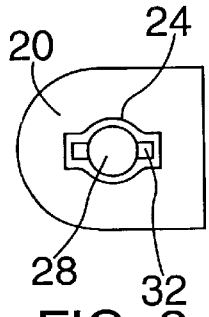
FIG. 3 PRIOR ART
FIG. 3 is a front end view of the prior art latch of FIGS. 1 and 2.
Figure 5:
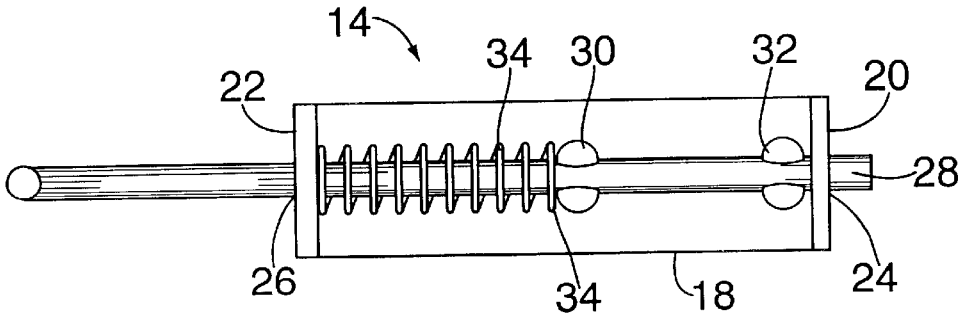
FIG. 5 PRIOR ART
FIG. 5 is a view similar to FIG. 2 of the prior art latch in the unlatched position.
Figure 6:
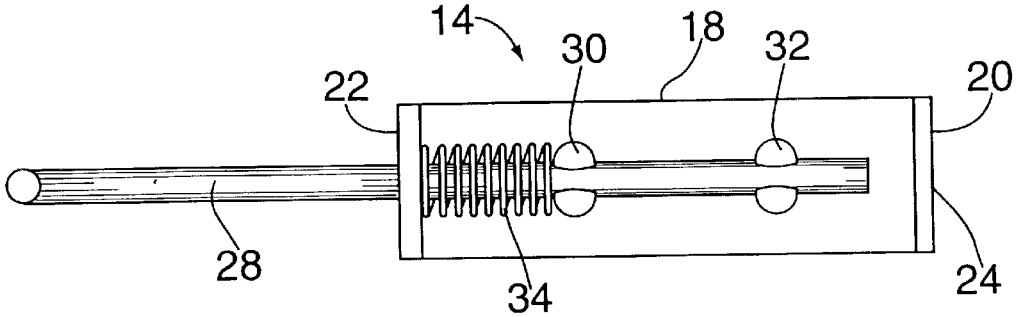
FIG. 6 PRIOR ART
FIG. 6 is a view similar to FIG. 2 of the prior art latch in a first stage of becoming disabled.
Figure 7:
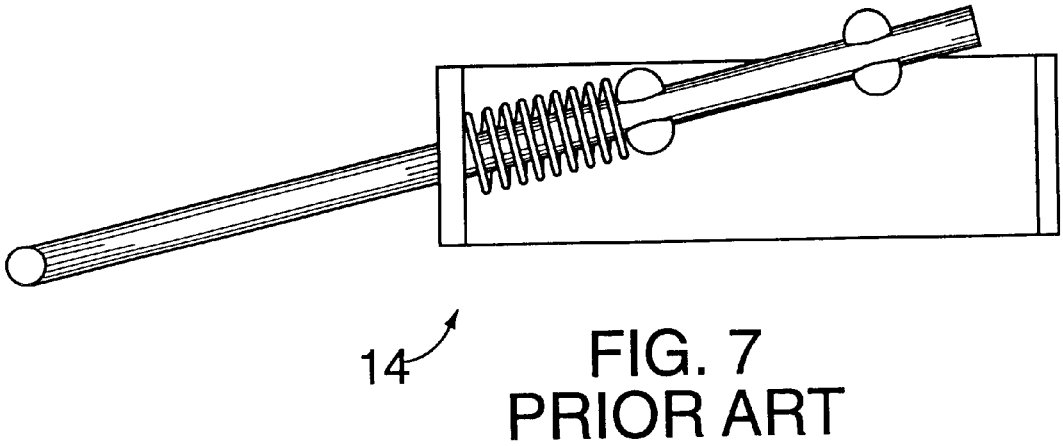
FIG. 7 PRIOR ART
FIG. 7 is a view similar to FIG. 6 of the prior art latch in a second stage of becoming disabled.
Figure 8:
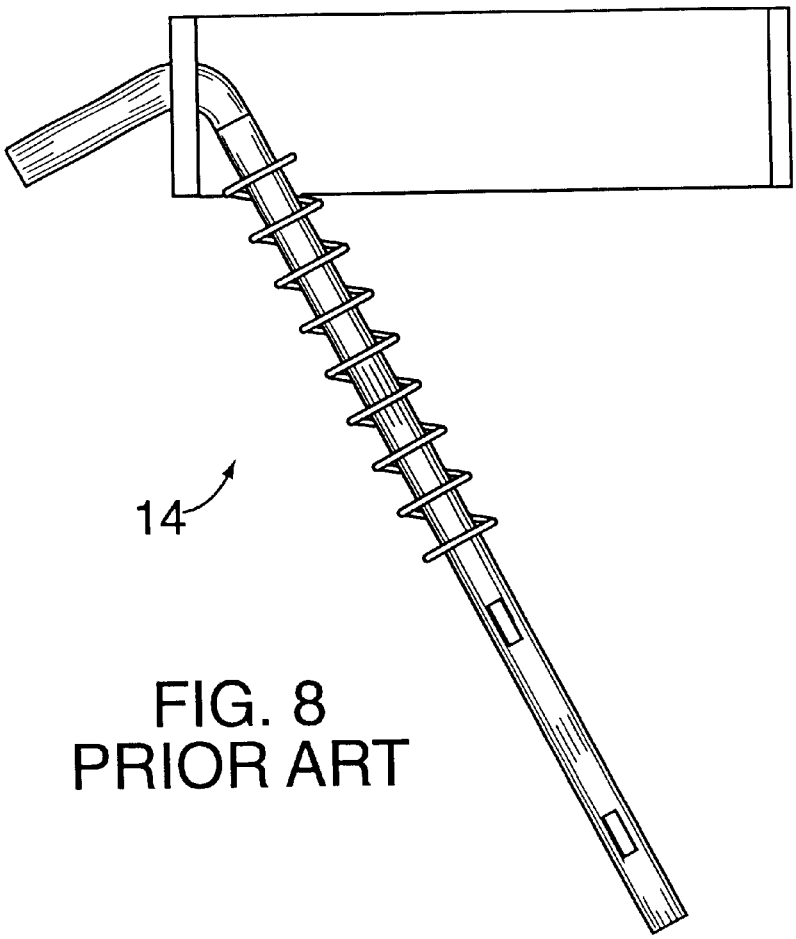
FIG. 8 PRIOR ART
FIG. 8 is a view similar to FIGS. 6 and 7 of the prior art latch in a fully disabled state.
Figure 9:
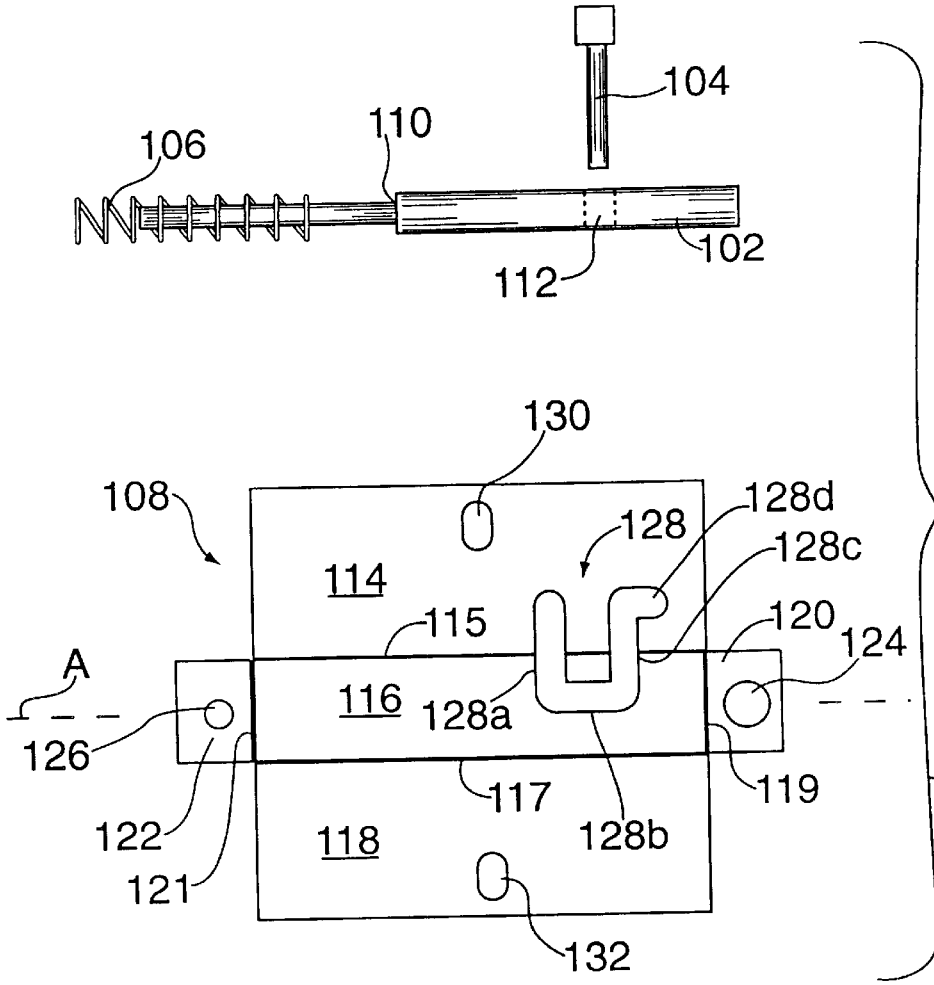
FIG. 9 is a plan view of the components of the latch of the invention prior to assembly.
Figure 10:
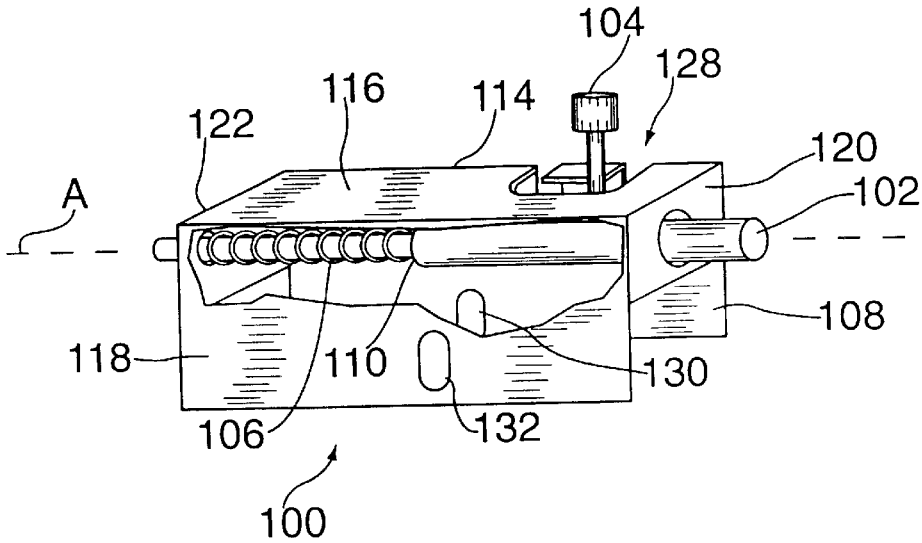
FIG. 10 is a transparent perspective view of the assembled latch.

Referring now to FIGS. 9 and 10, a latch 100 according to the invention generally includes a bolt 102, a bolt handle 104, a coil spring 106, and an angled bracket 108. According to a presently preferred embodiment, the bolt 102 is formed as a stepped cylinder to provide an annular point of engagement 110 for the coil spring 106. An orthogonal bore 112 is provided to receive the bolt handle 104 which is force fit into the hole. The angled bracket 108 is preferably formed from stamped sheet of aluminum which is folded along lines 115, 117, 119, 121 to define five panels 114, 116, 118, 120, 122. Prior to folding, the front panel 120 is cut to provide a front hole 124 and the rear panel 122 is cut to provide a rear hole 126. The side panels 114 and 116 are cut to provide a substantially U-shaped slot 128. In addition, the panels 114 and 118 are preferably cut to provide mounting holes 130, 132. After the panels are folded, the angled bracket 108 forms a box-like structure as shown in FIG. 10 wherein the front hole 124 and the rear hole 126 are substantially coaxial to a longitudinal axis "A" of the bracket 108. The bolt 102 is arranged with one end extending through the front hole 124 and the other end extending through the rear hole 126 with the spring 106 arranged coaxial to the bolt 102 with one end engaging the annular point of engagement 110 and the other end engaging the rear panel 122. The bolt handle 104 is attached to the bolt 102 through the slot 108 so that movement of the bolt is governed by movement of the handle through the slot.

With reference to the longitudinal axis "A" as shown in FIG. 9, it will be seen that the substantially U-shaped slot 128 has a rear portion 128*a* which is substantially orthogonal to the axis "A", a central portion 128*b* which is substantially parallel to the axis "A", and a front portion 128*c* which is substantially parallel to the rear portion 128*a*. According to a presently preferred embodiment, the slot 128 is provided with an additional forward portion 128*d* which is parallel to the central portion 128*b*.

From the foregoing, it will be appreciated that the maximum "throw" of the bolt 102 is limited to the distance between the forward end 128*d* and the rearward end 128*a* of the slot 128. It will further be appreciated that length of the bolt 102 and the location of the handle 104 are chosen such that the ends of the bolt remain in the holes 124, 126 throughout the "throw" of the bolt. In addition, it will be appreciated that in order to move the bolt 102 forward or rearward, the handle 104 must be moved through the slot 128. Since the slot 128 is located on two orthogonal sides (114, 116) of the bracket 108, movement of the handle 104 through the slot 128 will involve rotation of the bolt 104 in order for the bolt to be translated forward or rearward. According to the embodiment shown in FIGS. 9 and 10, those skilled in the art will appreciate that movement of the bolt 102 from the most forward position to the most rearward position will require translational movement as the handle is moved through the portion 128*d* of the slot, followed by rotational movement as the handle is moved through the portion 128*c* of the slot, and additional translational movement as the handle is moved through the portion 128*b* of the slot, all of which must be effected against the force of the spring 106. In addition, in order to hold the bolt 102 in the most rearward position, additional rotational movement will be required as the handle is moved through the portion 128*a* of the slot.

Figure 11:
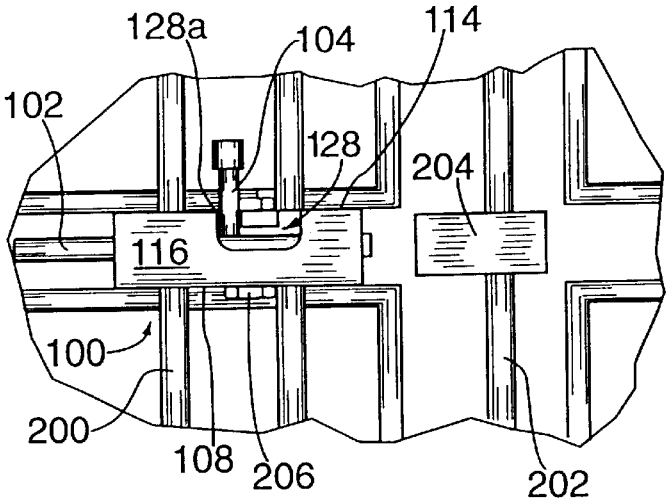
FIG. 11 is a side elevation view of the latch of the invention attached to a cage with the latch in the unlatched position.
Figure 12:
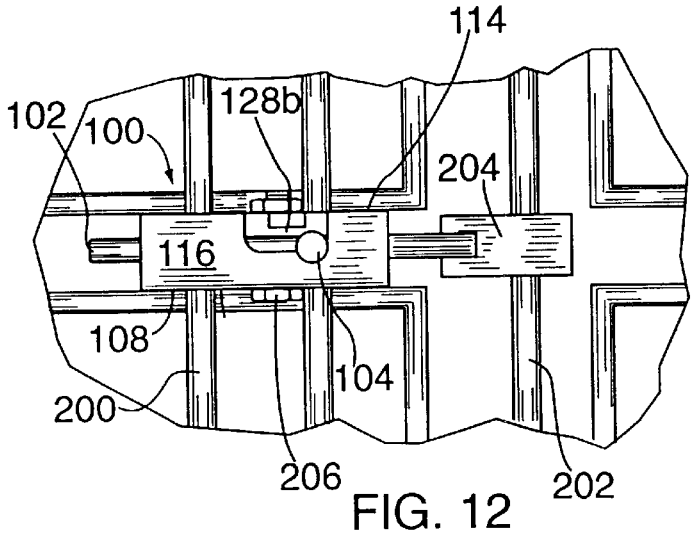
FIG. 12 is a view similar to FIG. 11 with the latch in a first latched position.
Figure 13:
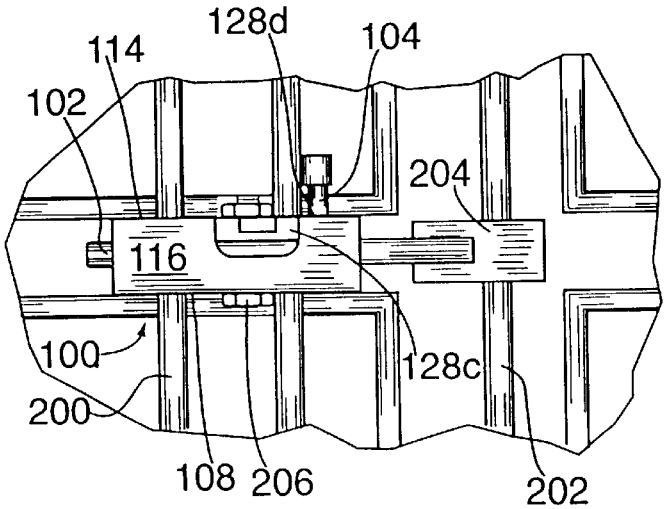
FIG. 13 is a view similar to FIGS. 11 and 12 with the latch in a second latched position.

Referring now to FIGS. 11–13, the operation of the latch 100 is illustrated in conjunction with an animal cage 200 having a hinged door 202 with a tab 204. The latch 100 is attached to the cage 200 with the aid of a bolt 206 which passes through the mounting holes 130, 132 (FIGS. 9 and 10) of the angled bracket 108. As shown in FIG. 11, the latch 100 is in the unlatched position with the bolt handle 104 residing in the most rearward portion 128*a* of the slot 128. The latch is moved to a first latched position shown in FIG. 12 by moving the handle 104 down into the portion 128*b* of the slot where action of the spring (not shown) biases the bolt 102 forward into an abutting position relative to the tab 204 of the door 202. The latch may then be moved to the second latched position shown in FIG. 13 by moving the handle 104 up into portion 128*c* of the slot 128 until it reaches portion 128*d* of the slot where action of the spring biases the bolt forward into portion 128*d* of the slot. From the foregoing, those skilled in the art will appreciate that the latch may be moved to the unlatched position by reversing the steps described above.

There has been described and illustrated herein an improved latching device which is particularly useful for latching the door of an animal cage. While particular embodiments of the invention have been described, it is not intended that the invention be limited thereto, as it is intended that the invention be as broad in scope as the art will allow and that the specification be read likewise. Thus, it will be appreciated that the latch of the invention may have other useful applications such as a childproof latch for gates and cabinet doors. In addition, it will be understood that an inventive feature of the latch is that the slot has at least two turns or bends such that the bolt must be both rotated and translated as it is moved against the action of the spring. Therefore, the slot may assume a configuration other than U-shaped. For example, a substantially Z-shaped or N-shaped slot may achieve similar results. It will be understood that the more bends the slot has, the more difficult it will be for an animal or child to move the bolt to the unlatched position. It will therefore be appreciated by those skilled in the art that yet other modifications could be made to the provided invention without deviating from its spirit and scope as so claimed.

What is claimed is:

1. An animal resistant, spring-biased latch for animal cages, comprising:

a) an angled bracket having a front flange having a front bolt-receiving hole and a rear flange having a rear bolt-receiving hole at opposite ends thereof, and three generally orthogonal sides having a generally U-shaped cross-sectional profile and a slot which traverses at least two of said sides;

b) a bolt having spring-engaging means and a bolt handle which is generally orthogonal to said bolt, said bolt being arranged to extend through said front hole and said rear hole and being arranged relative to said bracket such that said bolt handle extends through said slot, said bolt having a longitudinal axis, and a bolt locking end defining locking means for engaging a keeper and wherein the locking end is moveable between an unlocking position and a locking position in the latter of which said bolt locking end extends outwardly through said front bolt-receiving hole of said front flange; and c) spring means for biasing said bolt and said locking bolt end thereof toward said locking position, said spring means being a coil spring arranged coaxially with said bolt, said spring being disposed between said spring engaging means and said rear flange;

said slot having a rear portion which is generally orthogonal to said axis and which traverses two of said sides, a central portion which is generally parallel to said axis and which traverses only one of said sides, a front portion which is generally orthogonal to said axis and which traverses two of said sides, and a forward portion which is generally parallel to said axis and which traverses only one of said sides, said forward portion having a rear end which merges with said front portion and a front end which extends toward said front flange of said bracket, said bolt being movable against spring bias from said forward portion defining said locked position to said rear portion defining an unlocked position by moving said handle through said slot such that said bolt is rotated and translated relative to said bracket, and wherein movement of said bolt is restricted by said slot and said handle such that said bolt cannot be moved out of either of said holes.

2. A latch according to claim 1, wherein:

said spring engaging means is an annular step in said bolt.

3. A latch according to claim 1, wherein said slot has only four portions comprising said rear, central, front and forward portions.

4. A latch according to claim 1, wherein said angled bracket is in the form of a five-sided box made from a folded, stamped sheet of metal.

5. An animal resistant, spring-biased latch for animal cages, comprising:

a) an angled bracket having a front flange having a front bolt-receiving hole and a rear flange having a rear bolt-receiving hole at opposite ends thereof, and three generally orthogonal sides having a generally U-shaped cross-sectional profile and a slot which traverses at least two of said sides;

b) a bolt having spring-engaging means and a bolt handle which is generally orthogonal to said bolt, said bolt being arranged to extend through said front hole and said rear hole and being arranged relative to said bracket such that said bolt handle extends through said slot, said bolt having a longitudinal axis, and a bolt locking end defining locking means for engaging a keeper and wherein the locking end is moveable between an unlocking position and a locking position in the latter of which said bolt locking end extends outwardly through said front bolt-receiving hole of said front flange; and c) spring means for biasing said bolt and said locking bolt end thereof toward said locking position, said spring means being a coil spring arranged coaxially with said bolt, said spring being disposed between said spring engaging means and said rear flange;

said slot having a rear portion which is generally orthogonal to said axis and which traverses two of said sides, a central portion which is generally parallel to said axis and which traverses only one of said sides, a front portion which is generally orthogonal to said axis and which traverses two of said sides, and a forward portion which is generally parallel to said axis and which traverses only one of said sides, said forward portion having a rear end which merges with said front portion and a front end which extends toward said front flange of said bracket, said bolt being movable against spring bias from said forward portion defining said locked position to said rear portion defining an unlocked position by moving said handle through said slot such that said bolt is rotated and translated relative to said bracket, and wherein movement of said bolt is restricted by said slot and said handle such that said bolt cannot be moved out of either of said holes.

* * * * *